US009271556B2

(12) United States Patent
Wong et al.

(10) Patent No.: US 9,271,556 B2
(45) Date of Patent: Mar. 1, 2016

(54) AUTOMATIC COLORING DEVICE FOR MOVING COLORING TOOL ALONG A CURVE

(71) Applicant: Zong Jing Investment, Inc., Taipei (TW)

(72) Inventors: Charlene Hsueh-Ling Wong, Taipei (TW); John Chen, Taipei (TW); Chun-Liang Hsia, Taipei (TW)

(73) Assignee: ZONG JING INVESTMENT, INC., Taipei (TW)

( * ) Notice: Subject to any disclaimer, the term of this patent is extended or adjusted under 35 U.S.C. 154(b) by 220 days.

(21) Appl. No.: 14/094,075

(22) Filed: Dec. 2, 2013

(65) Prior Publication Data

US 2015/0016861 A1 Jan. 15, 2015

(30) Foreign Application Priority Data

Jul. 12, 2013 (TW) ..... 102125107 A

(51) Int. Cl.

| | |
|---|---|
| ***B05C 1/00*** | (2006.01) |
| ***A45D 40/26*** | (2006.01) |
| ***A45D 44/00*** | (2006.01) |
| *A45D 40/00* | (2006.01) |

(52) U.S. Cl.

CPC ..... *A45D 40/26* (2013.01); *A45D 40/00* (2013.01); *A45D 44/00* (2013.01); *A45D 44/005* (2013.01); *A45D 2040/0006* (2013.01)

(58) Field of Classification Search

CPC ..... A45D 44/005; A45D 40/00; A45D 40/26; A45D 2040/0006; B05C 1/00

USPC ..... 401/195; 118/209

See application file for complete search history.

(56) References Cited

U.S. PATENT DOCUMENTS

| | | | | |
|---|---|---|---|---|
| 7,648,364 | B2 * | 1/2010 | Dauga | A45D 44/005 434/100 |
| 8,464,732 | B2 * | 6/2013 | Wong | A45D 44/005 132/200 |
| 2012/0158184 | A1 * | 6/2012 | Ma | B25J 9/1679 700/264 |

FOREIGN PATENT DOCUMENTS

| | | |
|---|---|---|
| TW | 201212852 | 4/2012 |

* cited by examiner

*Primary Examiner* — Jennifer C Chiang

(74) *Attorney, Agent, or Firm* — Muncy, Geissler, Olds & Lowe, P.C.

(57) ABSTRACT

An automatic coloring device for moving coloring tool along a curve includes a guide-bar, a moving platform, a coloring tool, a first moving member and a second moving member. The moving platform is movably disposed on the guide-bar, and the coloring tool is disposed on the moving platform. The first moving member controls the guide-bar to move along a curve, and the second moving member controls the moving platform to move along the guide-bar. An axle center of the guide-bar penetrates the plane where the curve is disposed.

15 Claims, 7 Drawing Sheets

AUTOMATIC COLORING DEVICE FOR MOVING COLORING TOOL ALONG A CURVE

CROSS-REFERENCES TO RELATED APPLICATIONS

This non-provisional application claims priority under 35 U.S.C. §119(a) on Patent Application No. 102125107 filed in Taiwan, R.O.C. on 2013 Jul. 12, the entire contents of which are hereby incorporated by reference.

BACKGROUND

1. Technical Field

The disclosure relates to a technology field concerning with coloring, and particularly to an automatic coloring device for moving coloring tool along a curve.

2. Related Art

Conventionally, a 3D object is colored by manually operating coloring tools such as painting brushes, spray guns, etc. As to color makeup, for example, users draw various eyebrow shapes, various eye lines, eyelashes, eye contours, face makeup, labial makeup, appearance modifications, and various color changes on their faces or bodies or others. However, the make-up technique depends on the users' experiences; that is, the proficiency in the makeup technique is trained by the users' experiences. The difference in proficiency in the makeup technique and the wide range of cosmetics usually results in a difference between the effect of the makeup and the effect expected by the user.

As information technology continues to evolve, a simulation device for trying color makeup or a care product is provided by some research. In order to replace manual makeup, the user may simulate an effect of makeup on a screen of the color-makeup device, and then start the color-makeup device to makeup according to the simulated effect of makeup; for example, TW Patent Publication No. 201212852.

However, the conventional moving technology of the coloring tools is applied with a Cartesian coordinate system, such that the coloring tool is unsmooth and applied rigidly, resulting in lack of the elasticity and precision of application. Consequently, it is easy to form a jagged curve as a coloring track, such that the coloring effect is unnatural.

SUMMARY

In one embodiment, an automatic coloring device for moving coloring tool along a curve includes a guide-bar, a moving platform, a coloring tool, a first moving member and a second moving member. The moving platform is movably disposed on the guide-bar, and the coloring tool is disposed on the moving platform. The first moving member controls the guide-bar to move along a curve, and the second moving member controls the moving platform to move along the guide-bar. An axle center of the guide-bar penetrates the plane where the curve is disposed.

In some embodiments, the first moving member includes a moving structure and a motor. The moving structure is coupled to the guide-bar. The motor drives the moving structure to move the guide-bar along the curve.

In some embodiments, the moving structure includes a driving wheel and a driven wheel. A curve side of the driving wheel presents the curve, and the driven wheel is attached with the curve side of the driving wheel so as to move the guide-bar along the curve side by the driving of the motor.

In some embodiments, a surface of the curve side of the driving wheel has a plurality of first teeth, and the side surface of the driven wheel has a plurality of second teeth. The first teeth are engaged with the second teeth, so that the driven wheel is closely attached with the curve side of the driving wheel.

In some embodiments, the moving structure further includes a rotating shaft and a linking-up bar. The rotating shaft is rotatably disposed on the driving wheel and substantially parallel to the guide-bar. Two ends of the linking-up bar are fixed on the guide-bar and the rotating shaft, respectively.

In some embodiments, the linking-up bar has a telescopic structure so as to apply a pulling force between the guide-bar and the rotating shaft to maintain a close contact between the driven wheel and the curve side of the driving wheel.

In some embodiments, the motor is coupled to the rotating shaft so as to rotate the rotating shaft.

In some embodiments, the motor is capable of coupling to the driven wheel so as to rotate driven wheel.

In some embodiments, the curve is substantially perpendicular to the axle center of the guide-bar.

In some embodiments, the automatic coloring device for moving coloring tool along a curve further includes a supporting structure disposed corresponding to the coloring tool, for assembling an object, so that the coloring tool colors a surface of the object.

In some embodiments, a trend of the curve side corresponds to the outline of the surface of the object.

As above, the automatic coloring device according to the disclosure can be applied to color the surfaces of various non-planar objects to be colored, and use a curve corresponding to the outlines of the surfaces to be colored of the objects as the moving track of the guide-bar on a plate consisting of X axis and Z axis, i.e. restricting the guide-bar to only be moved along the curve corresponding to the outlines of the surfaces to be colored, thereby replacing the rigid movement, so as to improve the moving elasticity and the precision of coloring line, effectively reduce the moving time and the moving unit per unit time and further reduce energy consumption. In other words, the coloring efficiency and performance can be improved; additionally the coloring tools can be moved smoothly, so that jagged curves are not formed as a coloring track on the colored surface of the object. In some embodiments, motors are applied to rotate the moving structure, such that the moving structure controls the guide-bar moving along the curve, thereby significantly reducing the complexity of the construction.

The detailed features and advantages of the disclosure are described below in great detail through the following embodiments, the content of the detailed description is sufficient for those skilled in the art to understand the technical content of the disclosure and to implement the disclosure there accordingly. Based upon the content of the specification, the claims, and the drawings, those skilled in the art can easily understand the relevant objectives and advantages of the disclosure.

BRIEF DESCRIPTION OF THE DRAWINGS

The disclosure will become more fully understood from the detailed description given herein below for illustration only and thus not limitative of the disclosure, wherein.

DETAILED DESCRIPTION

Figure 1:
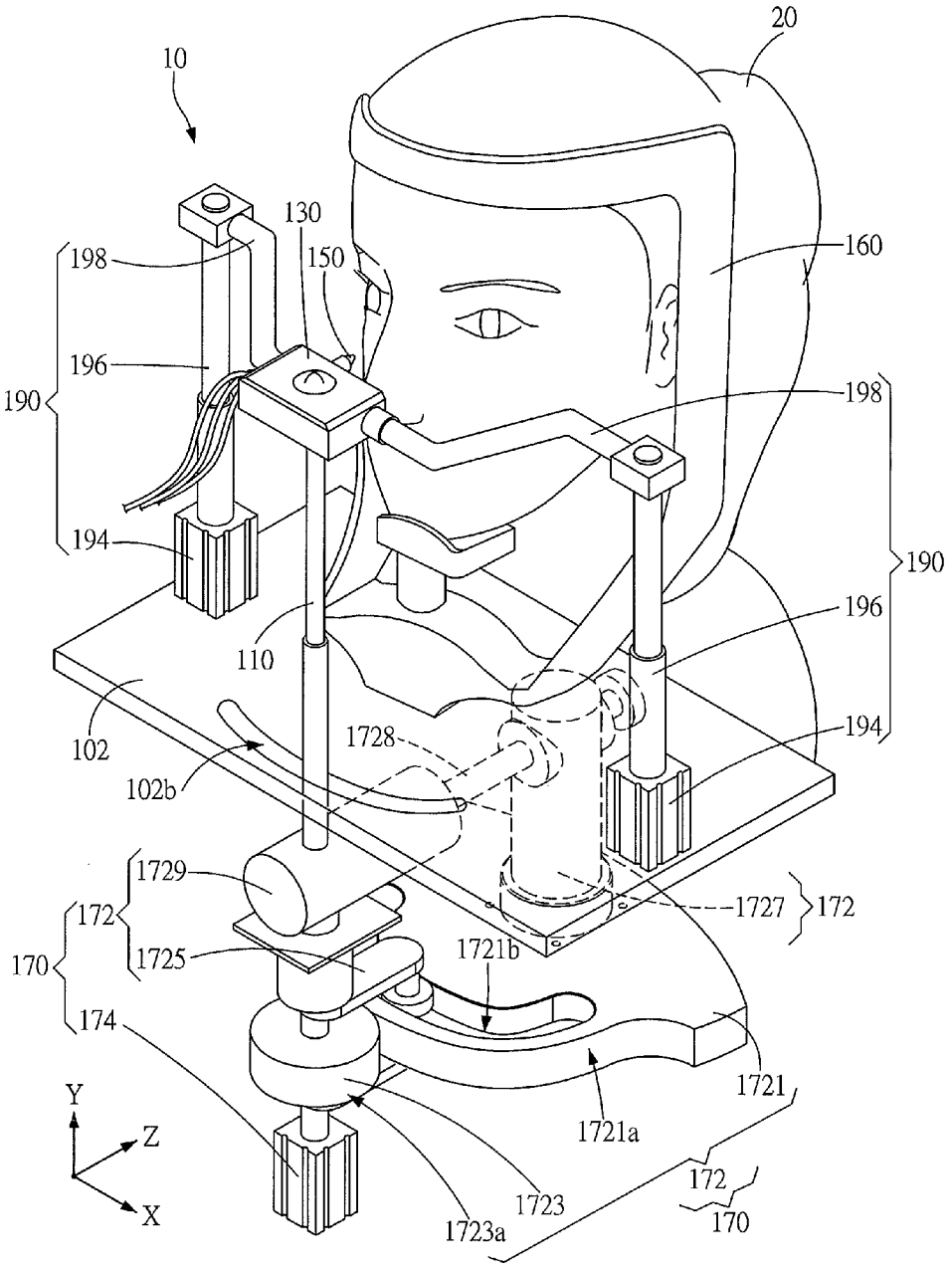
FIG. 1 is a schematic view of a first embodiment of an automatic coloring device for moving coloring tool along a curve.
Figure 2:
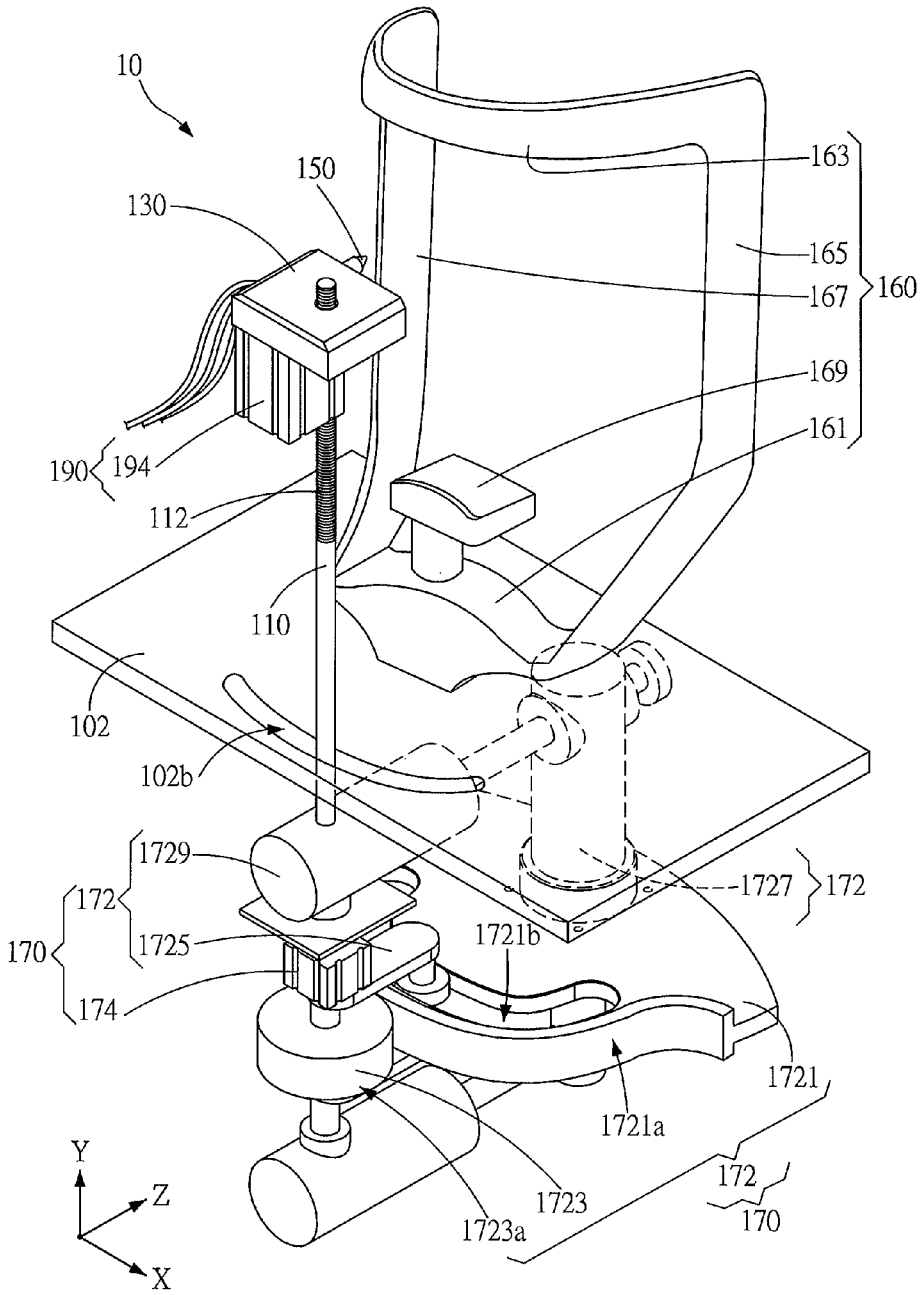
FIG. 2 is a schematic view of a second embodiment of an automatic coloring device for moving coloring tool along a curve.

FIG. 1 is a schematic view of a first embodiment of an automatic coloring device for moving coloring tool along a curve. FIG. 2 is a schematic view of a second embodiment of an automatic coloring device for moving coloring tool along a curve.

Please refer to FIGS. 1-2, in which an automatic coloring device 10 includes a guide-bar 110, a moving platform 130, a coloring tool 150, a first moving member 170 and a second moving member 190.

The moving platform 130 is movably disposed on the guide-bar 110, and the coloring tool 150 is disposed on the moving platform 130. The first moving member 170 controls the guide-bar 110 to move along a curve, and the second moving member 190 controls the moving platform 130 to move along the guide-bar 110. The axle center of the guide-bar 110 penetrates the plane where the curve is disposed. The first moving member 170 includes a moving structure 172 and a motor 174. The moving structure 172 is coupled to the guide-bar 110 and moves the guide-bar 110 along the curve by the driving of the motor 174.

In some embodiments, the moving structure 172 includes a driving wheel 1721 and a driven wheel 1723.

Upon looking up or down the driving wheel 1721, a side of the driving wheel 1721 presents the curve, referred to as curve side. That is, the lateral surface 1721*a* of the driving wheel 1721 heaves along the curve. Here, the driving wheel 1721 is a plate with the curve side, and the plate can be formed integrally as a whole or be consisted of a plurality of sub-plates. Further, the plate can be a solid plate or a hollow plate. In some embodiments, within allowable strength, the weight and/or the cost of the driving wheel 1721 can be reduced by material selection and/or hollow design adaption.

In some embodiments, the number of the driving wheel 1721 is one; while in some embodiments, the automatic coloring device 10 has a plurality of driving wheels 1721, and the driving wheels 1721 are fastened to be parallel aligned with each other, so that the curve sides of the driving wheels 1721 are aligned at the same plane.

The driven wheel 1723 is disposed on a first end of the guide-bar 110, and the moving platform 130 is disposed on a second end of the guide-bar 110. That is, the driven wheel 1723 and the moving platform 130 are disposed on two ends of the guide-bar 110, respectively. And, the moving platform 130 is capable of moving up and down along and in a segment of the second end of the guide-bar 110, namely, the moving platform 130 can move along the Y axis.

Here, the guide-bar 110 is inserted into or is passing through the driven wheel 1723, and the side of the driven wheel 1723 is closely attached with the curve side of the driving wheel 1721. That is, a lateral surface 1723*a* of the driven wheel 1723 is closely contacted with the lateral surface 1721*a* of the driving wheel 1721, such that a trend of the curve side of the driving wheel 1721 is substantially perpendicular to an axle center of the guide-bar 110.

Under the close contact between the lateral surface 1723*a* of the driven wheel 1723 and the lateral surface 1721*a* of the driving wheel 1721, the motor 174 drives the driven wheel 1723 to rotate, such that the driven wheel 1723 relatively moves on the lateral surface 1721*a* of the curve side of the driving wheel 1721, and at the same time, the guide-bar 110 is moved along the curve by the driven wheel 1723. That is, in the plane consisting of the X axis and the Z axis (hereafter called as XZ plane), the guide-bar 110 can only be moved along the curve.

In some embodiments, the driven wheel 1723 is rotatably disposed on the guide-bar 110. The motor 174 is coupled to the driven wheel 1723. The driven wheel 1723 is rotated by the motor 174, such that the driven wheel 1723 relatively moves on the first lateral surface 1721*a* of the driving wheel 1721, i.e. along the curve side of the driving wheel 1721. Since the lateral surface 1721*a* of the driving wheel 1721 has the outline as expansion of the curve, when the driven wheel 1723 is relatively moved in the lateral surface 1721*a* of the driving wheel 1721, the driven wheel 1723 drives the guide-bar 110 to move along the curve.

In some embodiments, a limiting structure 1725 is coupled to the guide-bar 110, so that when the driven wheel 1723 is rotated, the guide-bar 110 is stably moved along the curve without shaking or tilting. Here, the limiting structure 1725 can be U shape or U-like shape. Two ends of the limiting structure 1725 are fixed on the guide-bar 110, and a middle portion of the limiting structure 1725 is passing through a groove 1721*b* disposed in the driving wheel 1721. Here, the extension of the groove 1721*b* is substantially parallel to the extension of the lateral surface 1721*a* of the driving wheel 1721.

In some embodiments, the moving structure 172 further includes a rotating shaft 1727 and a linking-up bar 1729.

The rotating shaft 1727 is rotatably disposed on the driving wheel 1721 and substantially parallel to the guide-bar 110. Here, the rotating shaft 1727 is inserted into or passing through the driving wheel 1721. Two ends of the linking-up bar 1729 are respectively fixed on the guide-bar 110 and the rotating shaft 1727, so that the guide-bar 110 does not rotate with the rotation of the driven wheel 1723 and not shake or tilt when the driven wheel 1723 is rotating.

Figure 3:
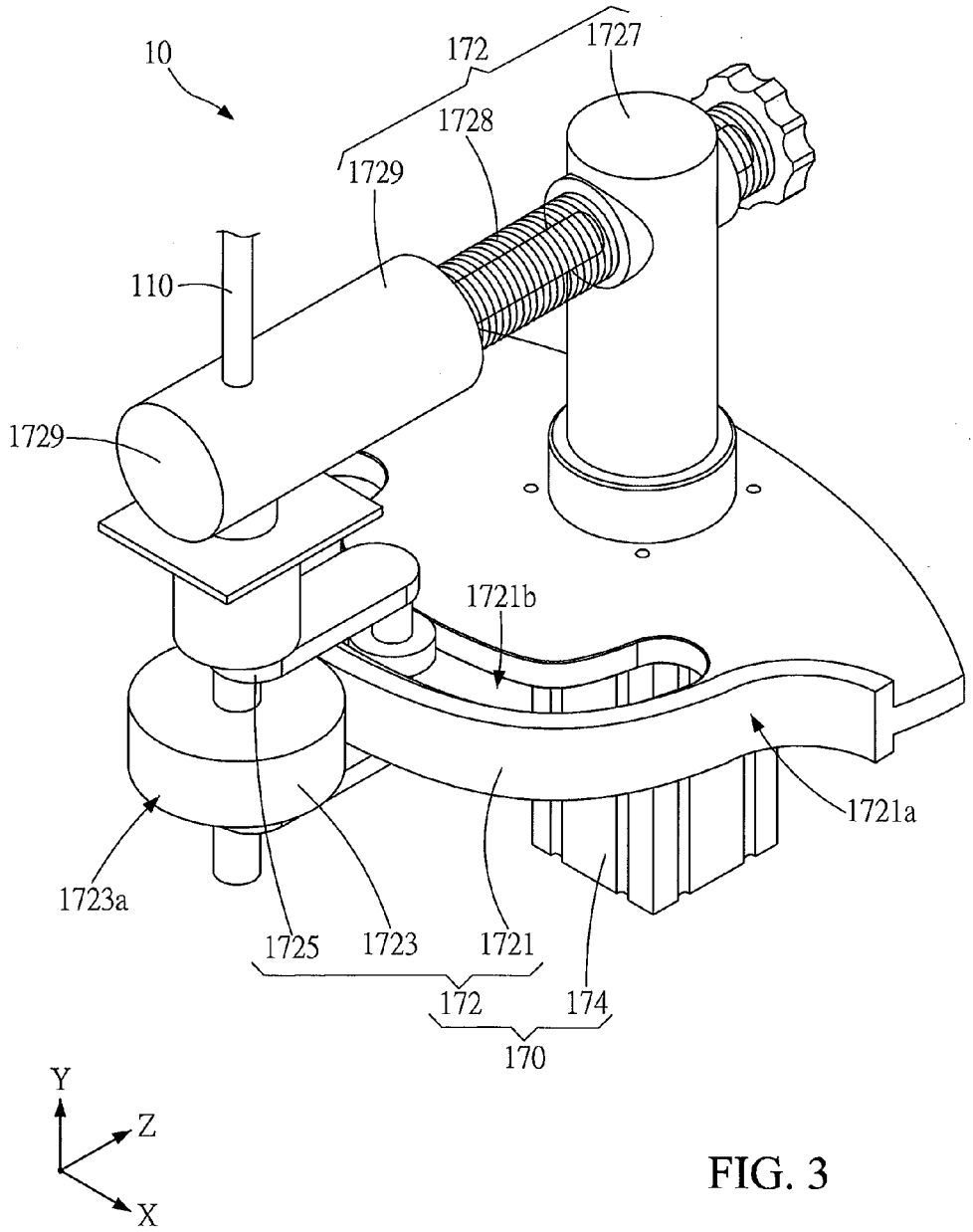
FIG. 3 is a schematic view of a third embodiment of an automatic coloring device for moving coloring tool along a curve.
Figure 4:
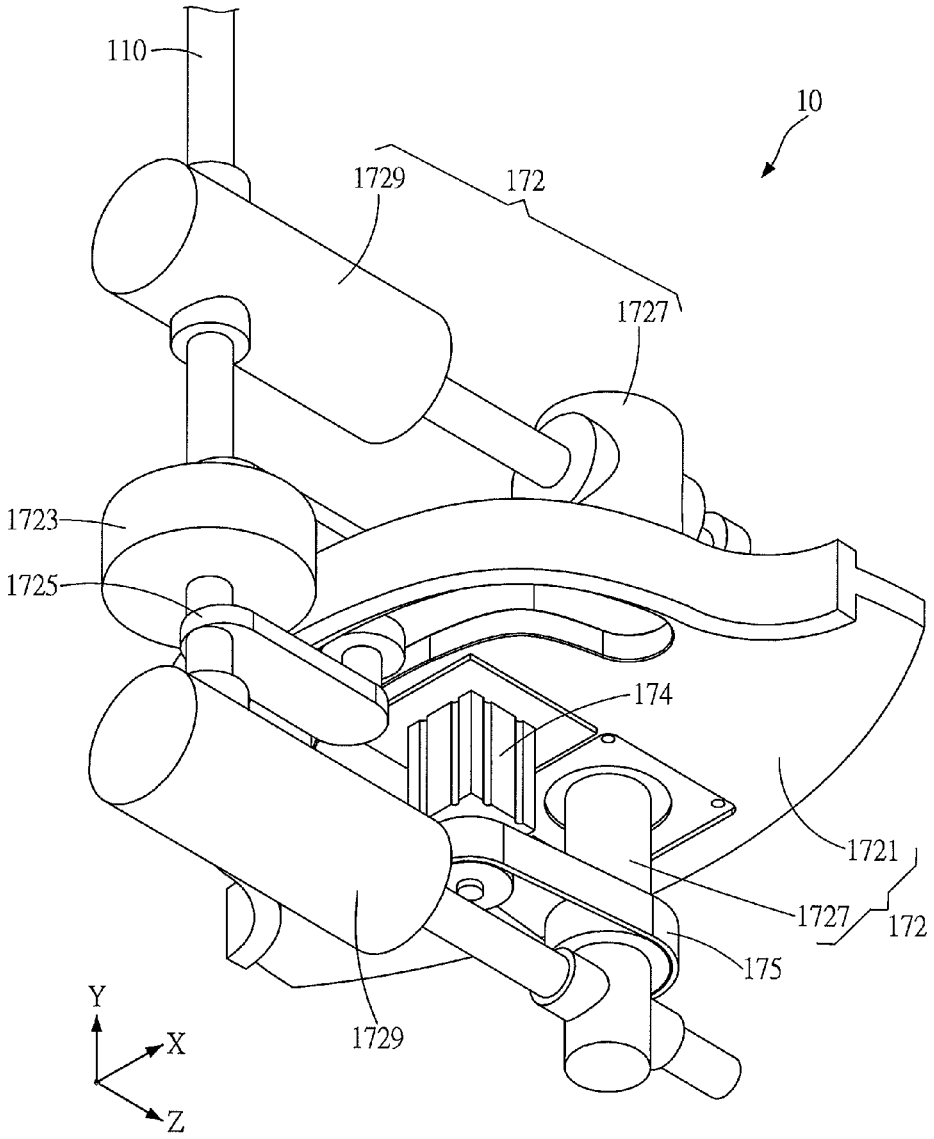
FIG. 4 is a schematic view of a fourth embodiment of an automatic coloring device for moving coloring tool along a curve.

FIG. 3 is a schematic view of a third embodiment of an automatic coloring device 10 for moving coloring tool along a curve of the disclosure. FIG. 4 is a schematic view of a fourth embodiment of an automatic coloring device 10 for moving coloring tool along a curve of the disclosure.

In some embodiments, as Please refer to FIGS. 3-4, the motor 174 can be arranged to couple with the rotating shaft 1727 directly or indirectly. The rotating shaft 1727 is rotated by the motor 174 so as to drive the linking-up bar 1729 to move the guide-bar 110. When the linking-up bar 1729 moves the guide-bar 110, since the lateral surface 1723*a* of the driven wheel 1723 is closely attached with the lateral surface 1721*a* of the driving wheel 1721, the driven wheel 1723 is relatively moved on the lateral surface 1721*a* of the driving wheel 1721, so as to drive the guide-bar 110 to move along the curve.

Please refer to FIG. 3, in which the motor 174 can be disposed on one end of the rotating shaft 1727 so as to rotate the rotating shaft 1727 directly. Additionally, please refer to FIG. 4, in which the motor 174 can be disposed on the driving wheel 1721, and rotate the rotating shaft 1727 indirectly via a driving belt 175 or a gear assembly (not shown).

In some embodiments, the linking-up bar 1729 can have a telescopic structure 1728, and two ends of the telescopic structure 1728 are respectively fixed on the guide-bar 110 and the rotating shaft 1727. The telescopic structure 1728 can apply a pulling force between the guide-bar 110 and the rotating shaft 1727 so as to maintain the close contact between the driven wheel 1723 and the curve side of the driving wheel 1721. Here, the telescopic 1728 can be a compressive spring (as shown in FIG. 3), an oil hydraulic unit (as shown in FIG. 1), a pneumatic unit, etc. The oil hydraulic unit includes an oil hydraulic bar and an oil hydraulic tank. One end of the oil hydraulic bar is fixed on the guide-bar 110, and the oil hydraulic tank drives the oil hydraulic bar to retract or to elongate. The pneumatic unit includes a pneumatic bar and a pneumatic tank. One end of the pneumatic bar is fixed on the guide-bar 110, and the pneumatic tank drives the pneumatic bar to retract or to elongate.

Figure 5:
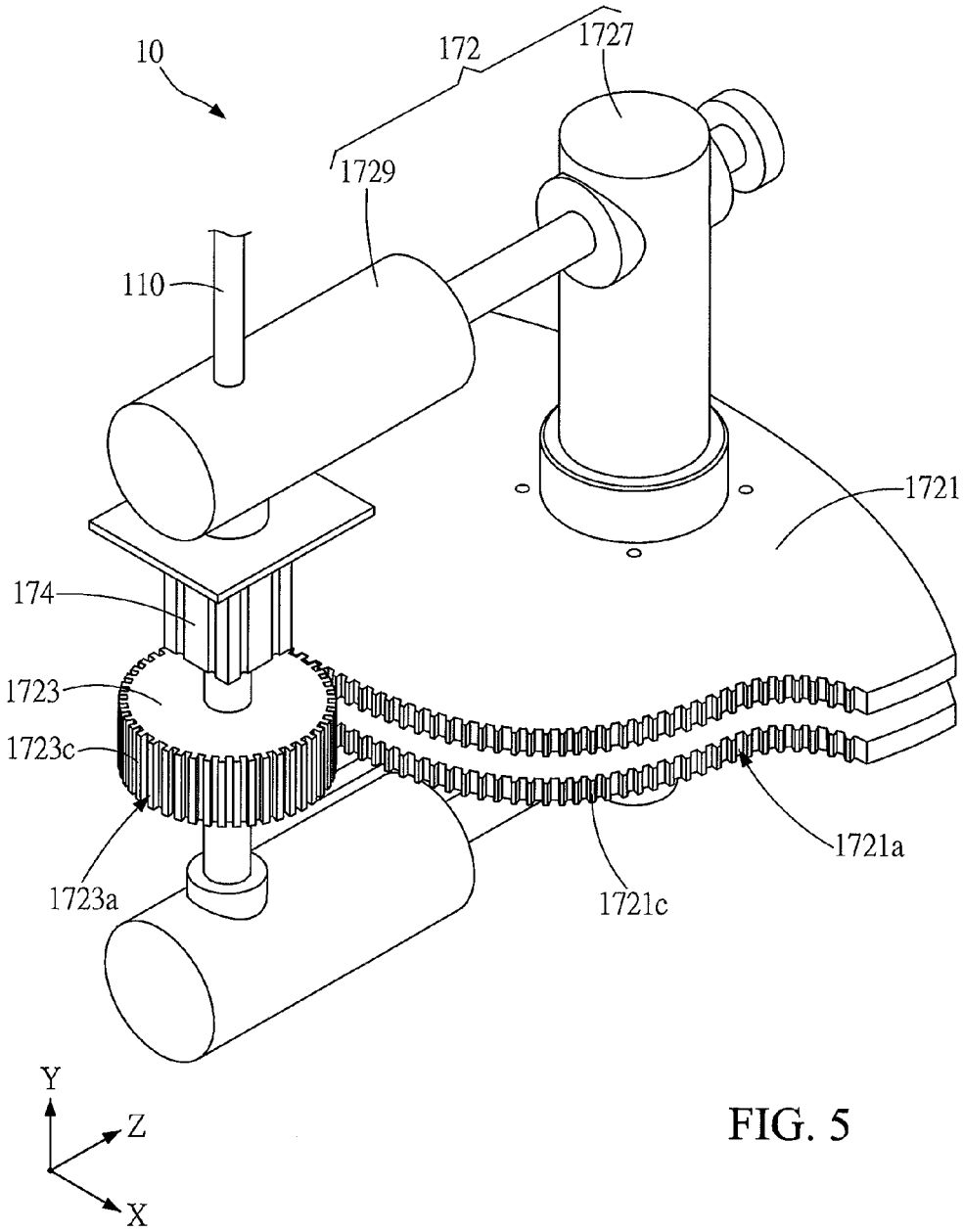
FIG. 5 is a schematic view of a fifth embodiment of an automatic coloring device for moving coloring tool along a curve.

FIG. 5 is a schematic view of a fifth embodiment of an automatic coloring device 10 for moving coloring tool along a curve of the disclosure.

In some embodiments, as please refer to FIG. 5, in which the lateral surface 1721*a* of the driving wheel 1721 has a jagged structure (referred to as first jagged structure) formed by a plurality of teeth 1721*c*, and the lateral surface 1723*a* of the driven wheel 1723 has a jagged structure (referred to as second jagged structure) formed by a plurality of teeth 1723*c*.

In other words, the curve side of the driving wheel 1721 is the jagged curve formed by the outlines of the teeth 1721*c*. The first jagged structure is engaged with the second jagged structure, so that the driven wheel 1723 is closely attached with the curve side of the driving wheel 1721.

In some embodiments, as please refer to FIG. 2, in which the second moving member 190 includes a motor 194. Here, the surface of the segment of the second end of the guide-bar 110 has a threaded structure 112, and the threaded structure 112 is passing through the moving platform 130 and is assembled with the moving platform 130.

The motor 194 drives the moving platform 130 to move in the threaded structure 112 (namely, to move along the Y axis), so that the coloring tool 150 on the moving platform 130 can be moved to a designated height.

In some embodiments, as please refer to FIG. 1, in which the second moving member 190 can include one or two motors 194, one or two telescopic bars 196, and one or two linking-up bars 198. The motors 194 are respectively corresponding to the telescopic bars 196 and the linking-up bars 198 are respectively corresponding to the telescopic bars 196.

The sub motor 194 is disposed on a first end of the corresponding telescopic bar 196. Two ends of the linking-up bar 198 are respectively fixed on a second end of the corresponding telescopic bar 196 and the moving platform 130. The motor 194 drives the corresponding telescopic bar 196 to retract or elongate, so that the corresponding linking-up bar 198 drives the moving platform 130 to move up or to move down along the Y axis.

Here, when a plenty of linking-up bars 198 are arranged, the linking-up bars 198 are respectively fixed around the moving platform 130 so as to move the moving platform 130 stably. For example, when two linking-up bars 198 are arranged, the two linking-up bars 198 are respectively fixed on the two sides (opposite to each other), of the moving platform 130 and extended away from the moving platform 130.

Please refer to FIG. 1 and FIG. 2, in which the automatic coloring device 10 can further include a stage 102 and a supporting structure 160.

The stage 102 has a groove 102*b*. The extension shape of the groove 102*b* corresponds to the curve (namely, the extension of the lateral surface 1721*a* of the driving wheel 1721). That is, the second groove 102*b* also presents the curve.

In some embodiments, the extension shape of the groove 102*b* and the cure curve of the driving wheel 1721 can be the arced segments of two concentric circles respectively.

The guide-bar 110 is passing through the groove 102*b*, and the first and second ends of the guide-bar 110 are respectively located at an upper and bottom sides of the stage 102. That is, the moving platform 130 is disposed above the stage 102, and the first moving member 170 is disposed below the stage 102. The guide-bar 110 can be moved within the groove 102*b*, so that when the first moving member 170 moves the guide-bar 110, the guide-bar 110 does not lean upon the stage 102 resulting in unstable conditions, such as abnormal shifting, shaking or tilting, of the guide-bar 110.

The supporting structure 160 corresponds to the coloring tool 150 and is fastened on the stage 102. That is, the painting portion of the coloring tool 150 faces to the supporting structure 160. The supporting structure 160 is provided to assemble an object 20 to be colored. Here, the object 20 can be a three-dimensional object 20, and the surface to be colored of the object 20 can be a non two-dimensional flat surface. Here, the aforementioned curve corresponds to the heaving outline of the surface to be colored of the object 20. In some embodiments, the trend of the curve is substantially equal to the heaving outline of the surface to be colored of the object 20. The trend of curve (namely, the shape and the outline of the curve side of the driving wheel 1721), can be acquired by firstly sampling a certain amount of surfaces of sampling objects followed with gathering statistics from the sampled data. The sampled surfaces of sampling objects corresponds to the surface of the object 20 to be colored, and their type are the same.

The supporting structure 160 includes a fastening portion 161, an abutting portion 163, at least one supporting member 165, 167, and a loading portion 169.

The fastening portion 161 is fastened on the stage 102. The loading portion 169 is disposed on the fastening portion 161. The abutting portion 163 is disposed above the loading portion 169. The supporting members 165, 167 are coupled between the fastening portion 161 and the abutting portion 163 so as to keep a distance between the abutting portion 163 and the fastening portion 161 (namely, the height along Y axis). The loading portion 169 abuts against and loads the bottom parts of the object 20, and the abutting portion 163 abuts against the upper parts of the object 20, so that the position of object 20 is maintained and fixed (with respect to the Y axis).

In some embodiments, a distance between the supporting members 165, 167 is slightly larger than a width of the object 20. Preferably, the distance between the supporting members 165, 167 is larger than the width of the object 20 by no more than 2 centimeters.

In some embodiments, the middle portions of the supporting members 165, 167 are extended away from the coloring tool 150 (or the moving platform 130). That is to say, as compared to the middle portions of the supporting members 165, 167, the two ends of the supporting members 165, 167 are closer to coloring tool 150 (or the moving platform 130). Based on this, the position of the object 20 is limited by the supporting members 165, 167 (with respect to the X axis).

In some embodiments, the fastening portion 161, the abutting portion 163 and the supporting members 165, 167 are formed integrally as a whole; namely, the fastening portion 161, the abutting portion 163 and the supporting members 165, 167 are formed as a frame. In some embodiments, the fastening portion 161, the abutting portion 163, the supporting members 165, 167 and the loading portion 169 are formed integrally as a whole. That is to say, the middle portion of the fastening portion 161 is larger than the two ends of the fastening portion 161 so as to form the loading portion 169 with saddle-like shaped.

Taking the make-up for example, as please refer to FIG. 1 and FIG. 2, in which the surface to be colored of the object 20 can be the face of a user. The abutting portion 163 corresponds to the forehead of the user so as to be arc-shaped. During the make-up process, the forehead of the user is attached to the abutting portion 163, and the chin of the user is attached to the loading portion 169, so as to ensure the corresponding positional relationship between the face of the user and the moving platform 130. Here, a trend of the curve corresponds to the outline of the face of the user. The curve can be acquired by firstly sampling a certain amount of outlines of humans' faces followed with gathering statistics from the sampled data. Here, the humans sampled can be the same race, the same age, the same gender or the combination thereof.

Figure 6:
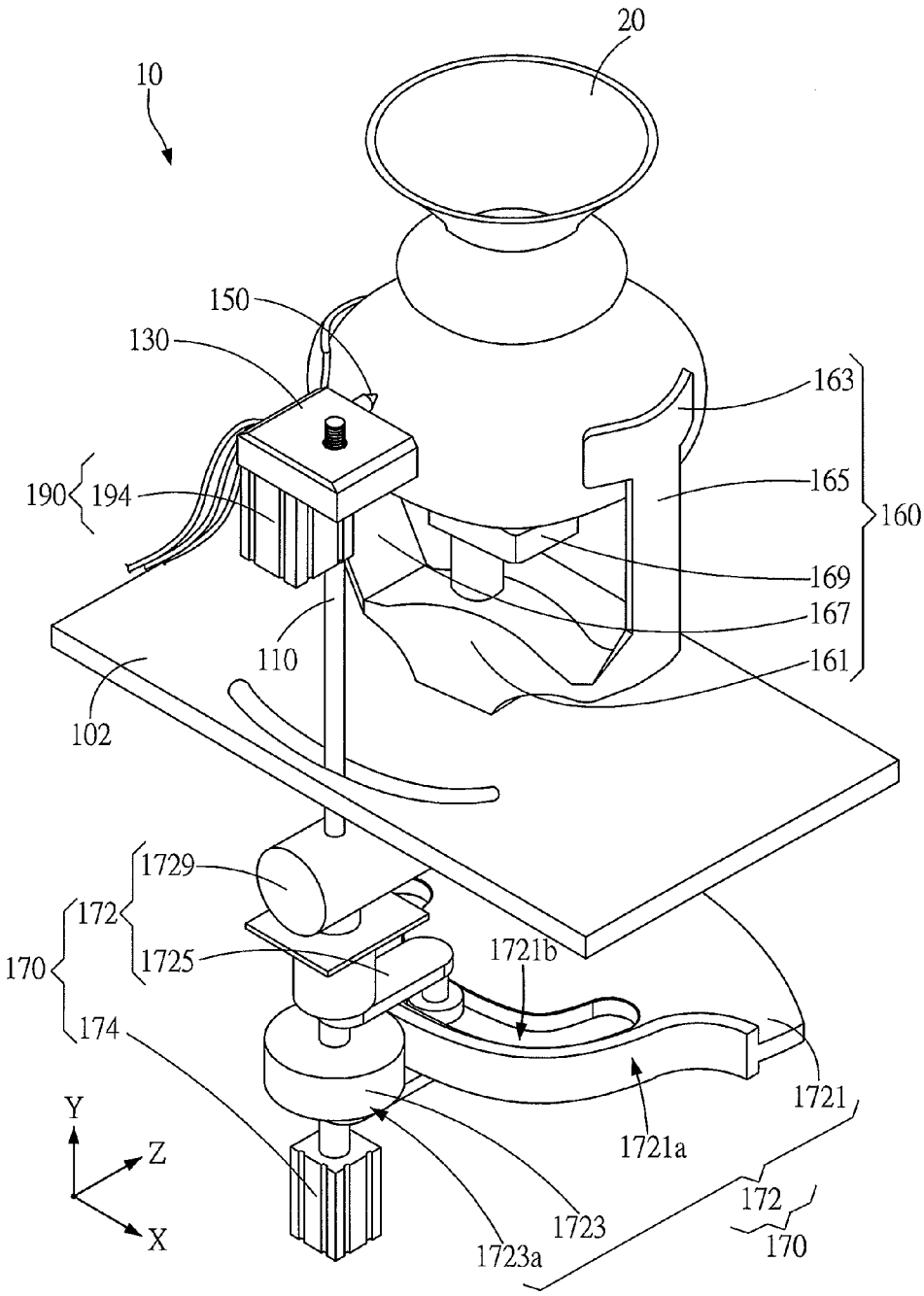
FIG. 6 is a schematic view of a sixth embodiment of an automatic coloring device for moving coloring tool along a curve.

Taking painting a vast for example, as please refer to FIG. 6, in which the surface to be colored of the object 20 can be the surface of the vast. During the painting process, the vast puts on the loading portion 169, so as to ensure the corresponding positional relationship between the surface of the vast and the moving platform 130. Here, the trend of the curve corresponds to the outline of the body (i.e. the surface to be colored), of the vast. Here, the supporting members 165, 167 are arranged as a clamping member, or the abutting portion 163 and the loading portion 169 are arranged as the clamping member (not shown), so as to clamp the vast to be colored. Here, the trend of the curve corresponds to the outline of the surface of the vast.

Figure 7:
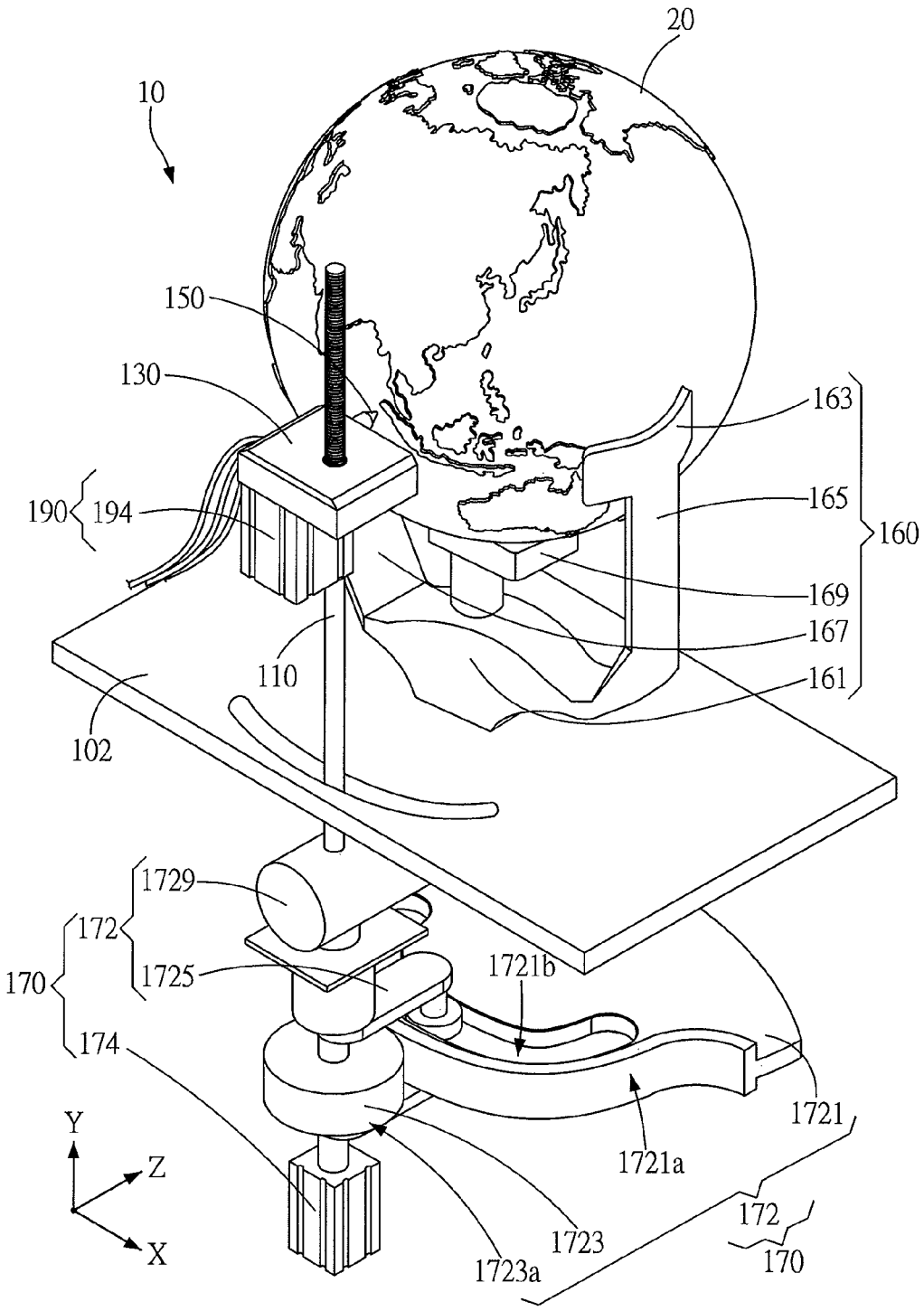
FIG. 7 is a schematic view of a seventh embodiment of an automatic coloring device for moving coloring tool along a curve.

Taking painting a terrestrial globe for example, as please refer to FIG. 7, in which the surface to be colored of the object 20 can be the surface of the terrestrial globe. The terrestrial globe is positioned on the loading portion 169 so as to ensure the corresponding positional relationship between the surface of the terrestrial globe and the moving platform 130. Here, the supporting members 165, 167 are arranged as a clamping member, or the abutting portion 163 and the loading portion 169 are arranged as the clamping member (not shown), so as to clamp the terrestrial globe. Here, the trend of the curve corresponds to the outline of the surface of the terrestrial globe.

In some embodiments, the moving platform 130 can drive the coloring tool 150 to move along the Z axis, so that the coloring tool 150 moves toward the surface to be colored of the object 20. Since the guide-bar 110 is limited within the curve corresponding to the outline of the surface to be colored of the object 20, the moving distance of the moving platform 130 (or the coloring tool 150) along Z axis can be reduced. In some embodiments, the moving platform 130 further has a tilting structure, and the coloring tool 150 is disposed on the tilting structure. The tilting structure controls the tilting angle of the coloring tool 150; that is, the painting direction of the coloring tool 150 can be parallel, tilting upward or tilting downward with respect to the XZ plane.

In some embodiments, with respect to the object 20 to be colored, the coloring tool 150 can be a contact type coloring tool, a contactless type coloring tool or the combination thereof. For instance, the contactless type coloring tool is a nozzle, an injector or equivalent tools. The contactless type coloring tool has one or more than one discharge holes, and the discharge holes face to the supporting structure 160 and are provided to spray the paints onto the ready-to-color surface of the object 20 on the supporting structure 160. The contact type coloring tool is a brush, a powder puff, a paintbrush or equivalent tools. The contact type coloring tool has one or more than one front ends (such as the free end of the brush, the tip of the paintbrush etc.). The front end of the contact type coloring tool points toward the supporting structure 160 and is provided to paint the paints onto the ready-to-color surface of the object 20 on the supporting structure 160.

As above, the automatic coloring device 10 according to the disclosure can be applied to color the surfaces of various non-planar objects to be colored, and use a curve corresponding to the outlines of the surfaces to be colored of the objects 20 as the moving track of the guide-bar 10 on a plate consisting of X axis and Z axis, i.e. restricting the guide-bar 10 to only be moved along the curve corresponding to the outlines of the surfaces to be colored, thereby replacing the rigid movement, so as to improve the moving elasticity and the precision of coloring line, effectively reduce the moving time and the moving unit per unit time and further reduce energy consumption. In other words, the coloring efficiency and performance can be improved; additionally the coloring tools 150 can be moved smoothly, so that jagged curves are not formed as a coloring track on the colored surface of the object 20. In some embodiments, motors 174 are applied to rotate the moving structure 172, such that the moving structure 172 to controls the guide-bar 110 moving along the curve, thereby significantly reducing the complexity of the construction.

While the disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An automatic coloring device for moving coloring tool along a curve, comprising:

a guide-bar;

a moving platform, movably disposed on the guide-bar;

a coloring tool, disposed on the moving platform;

a first moving member, for controlling the guide bar to move along a curve, wherein an axle center of the guide-bar penetrates a plane where the curve is disposed; and a second moving member, for controlling the moving platform to move along the guide-bar.

2. The automatic coloring device for moving coloring tool along a curve according to claim 1, wherein the first moving member comprises:

a moving structure, coupled to the guide-bar; and a motor, for driving the moving structure to move the guide-bar along the curve.

3. The automatic coloring device for moving coloring tool along a curve according to claim 2, wherein the moving structure comprises:

a driving wheel, having a curve side presenting the curve; and a driven wheel, attached with the curve side, for driving the guide-bar to move along the curve side by the driving of the motor.

4. The automatic coloring device for moving coloring tool along a curve according to claim 3, wherein a surface of the curve side of the driving wheel has a plurality of first teeth, and a side surface of the driven wheel has a plurality of second teeth, the first teeth are engaged with the second teeth, so that the driven wheel is closely attached with the curve side of the driving wheel.

5. The automatic coloring device for moving coloring tool along a curve according to claim 4, wherein the moving structure further comprises:

a rotating shaft, rotatably disposed on the driving wheel and substantially parallel to the guide-bar; and a linking-up bar, two ends of the linking-up bar fixed on the guide-bar and the rotating shaft, respectively.

6. The automatic coloring device for moving coloring tool along a curve according to claim 5, wherein the linking-up bar has a telescopic structure, for applying a pulling force between the guide-bar and the rotating shaft to maintain a close contact between the driven wheel and the curve side of the driving wheel.

7. The automatic coloring device for moving coloring tool along a curve according to claim 5, wherein the motor is coupled to the rotating shaft so as to rotate the rotating shaft.

8. The automatic coloring device for moving coloring tool along a curve according to claim 4, wherein the motor is coupled to the driven wheel so as to rotate the driven wheel.

9. The automatic coloring device for moving coloring tool along a curve according to claim 3, wherein the moving structure further comprises:

a rotating shaft, rotatably disposed on the driving wheel and substantially parallel to the guide-bar; and a linking-up bar, two ends of the linking-up bar fixed on the guide-bar and the rotating shaft, respectively.

10. The automatic coloring device for moving coloring tool along a curve according to claim 9, wherein the linking-up bar has a telescopic structure, for applying a pulling force between the guide-bar and the rotating shaft to maintain a close contact between the driven wheel and the curve side of the driving wheel.

11. The automatic coloring device for moving coloring tool along a curve according to claim 9, wherein the motor is coupled to the rotating shaft to rotate the rotating shaft.

12. The automatic coloring device for moving coloring tool along a curve according to claim 3, wherein the motor is coupled to the driven wheel so as to rotate the driven wheel.

13. The automatic coloring device for moving coloring tool along a curve according to claim 1, wherein a trend of the curve side is substantially perpendicular to the axle center of the guide-bar.

14. The automatic coloring device for moving coloring tool along a curve according to claim 1, further comprising:

a supporting structure, disposed corresponding to the coloring tool, for assembling an object so that the coloring tool colors a surface of the object.

15. The automatic coloring device for moving coloring tool along a curve according to claim 14, wherein a trend of the curve side corresponds to the outline of the surface of the object.

* * * * *